US010267088B2

(12) United States Patent
Marmion et al.

(10) Patent No.: US 10,267,088 B2
(45) Date of Patent: Apr. 23, 2019

(54) ADJUSTABLE GATE APPARATUS, SYSTEM AND METHOD

(71) Applicants: David Marmion, Canyon Country, CA (US); Erik Marmion, Canyon Country, CA (US)

(72) Inventors: David Marmion, Canyon Country, CA (US); Erik Marmion, Canyon Country, CA (US)

( * ) Notice: Subject to any disclaimer, the term of this patent is extended or adjusted under 35 U.S.C. 154(b) by 0 days.

(21) Appl. No.: 14/999,708

(22) Filed: Jun. 16, 2016

(65) Prior Publication Data

US 2017/0362894 A1 Dec. 21, 2017

(51) Int. Cl.
*E06B 11/02* (2006.01)

(52) U.S. Cl.
CPC ..... *E06B 11/02* (2013.01)

(58) Field of Classification Search
CPC ..... E06B 2009/002
See application file for complete search history.

(56) References Cited

U.S. PATENT DOCUMENTS 604,411 A * 5/1898 Motley ..... E06B 9/522 160/224
2,149,607 A * 3/1939 Keiser ..... E06B 3/52 16/233
4,611,431 A * 9/1986 Lauro ..... E06B 9/02 49/55
5,117,585 A * 6/1992 Andrisin, III ..... E06B 9/04 49/55
5,367,829 A * 11/1994 Crossley ..... E05B 65/0014 49/465
5,570,543 A * 11/1996 Bishop ..... E05B 65/0014 160/216
5,797,218 A * 8/1998 Holland ..... E06B 9/04 49/55
6,176,043 B1 * 1/2001 Gibbs ..... E05B 9/08 49/449
6,178,694 B1 * 1/2001 Wagnitz ..... E05B 65/0014 160/225
6,516,568 B2 * 2/2003 Yang ..... E05B 65/0007 49/463
6,536,502 B2 * 3/2003 Britto ..... E06B 9/08 160/23.1
7,322,153 B2 * 1/2008 Nitz ..... E06B 9/04 49/394
7,334,624 B2 * 2/2008 Waldman ..... E05B 17/2053 160/144

(Continued)

*Primary Examiner* — Catherine A Kelly

(57) ABSTRACT

An adjustable gate is provided. The adjustable gate includes a body having an upper horizontal element and a lower horizontal element. The body also includes a first vertical side member, and a second vertical side member, with the upper and the lower horizontal elements moveably coupled to the first and second vertical side members. A hinge post has a first elongated member having a hinge and an adjustable hinge post mounting tab. A latch post has a second elongated member having a latch apparatus and an adjustable latch post mounting tab. The adjustable hinge post and latch post mounting tabs are structured to couple to a mounting surface, and the hinge is structured to couple to either the first or second vertical side members and the latch apparatus is structured to removeably couple to either the first or second vertical side members.

8 Claims, 5 Drawing Sheets

(56) References Cited

U.S. PATENT DOCUMENTS

| | | | | |
|---|---|---|---|---|
| 7,565,769 | B2 * | 7/2009 | Monahan | E06B 9/04 49/394 |
| 7,627,985 | B2 * | 12/2009 | Marsden | E05B 65/0014 49/394 |
| 7,874,103 | B2 * | 1/2011 | Yates | E06B 9/04 49/226 |
| 8,196,348 | B2 * | 6/2012 | Flannery | E06B 9/04 49/465 |
| 8,596,619 | B2 * | 12/2013 | Volin | E04H 17/163 256/73 |
| 8,627,602 | B2 * | 1/2014 | Yates | E06B 9/04 49/55 |
| 8,713,851 | B2 * | 5/2014 | Flannery | E06B 9/04 49/465 |
| 8,863,811 | B2 * | 10/2014 | Yates | E06B 9/0623 160/136 |
| 9,382,740 | B2 * | 7/2016 | Flannery | E05D 7/10 |
| 9,874,056 | B1 * | 1/2018 | Flannery | E06B 9/04 |
| 2008/0307708 | A1 * | 12/2008 | Quan | E06B 9/02 49/55 |
| 2011/0308160 | A1 * | 12/2011 | Boucquey | E05B 65/0007 49/50 |
| 2012/0279146 | A1 * | 11/2012 | Thomas | E06B 11/02 52/126.1 |
| 2017/0058594 | A1 * | 3/2017 | Marsden | E05D 11/1007 |
| 2017/0058595 | A1 * | 3/2017 | Marsden | E05B 65/0007 |
| 2017/0211314 | A1 * | 7/2017 | Raffi | E06B 9/04 |
| 2017/0350165 | A1 * | 12/2017 | Schort | E05B 65/0007 |
| 2018/0112457 | A1 * | 4/2018 | Raffi | E06B 9/04 |

* cited by examiner

ADJUSTABLE GATE APPARATUS, SYSTEM AND METHOD

FIELD OF THE INVENTION

The present invention generally relates to enclosure systems. More particularly, the invention concerns an adjustable gate for obstructing entrances, exits, walkways and the like.

BACKGROUND OF THE INVENTION

Enclosures provide an important function in society—they keep people and animals from entering unsafe areas, and well as preventing them from trespassing or wandering without supervision. For example, they keep children and pets from entering pools and from wandering in neighborhoods without the knowledge of the parent or owner.

Virtually all enclosures include one or more gates for allowing access into, and out of, the enclosure. However, when mounting a gate to a post, wall or other surface, problems arise when the mounting surface is not "plumb." That is, the post or wall is not exactly vertical or perpendicular to the ground. Also, in many cases, the surface across which the gate will extend is not level. For example, a gate may be located between a fence post and a wall, and the ground between the two is not exactly level, or horizontal. Installing a gate in these situations is problematic at best, and more often, very difficult.

Therefore, there remains a need to overcome one or more of the limitations in the above-described, existing art. The discussion of the background to the invention included herein is included to explain the context of the invention. This is not to be taken as an admission that any of the material referred to was published, known or part of the common general knowledge as at the priority date of the claims.

Figure 1:
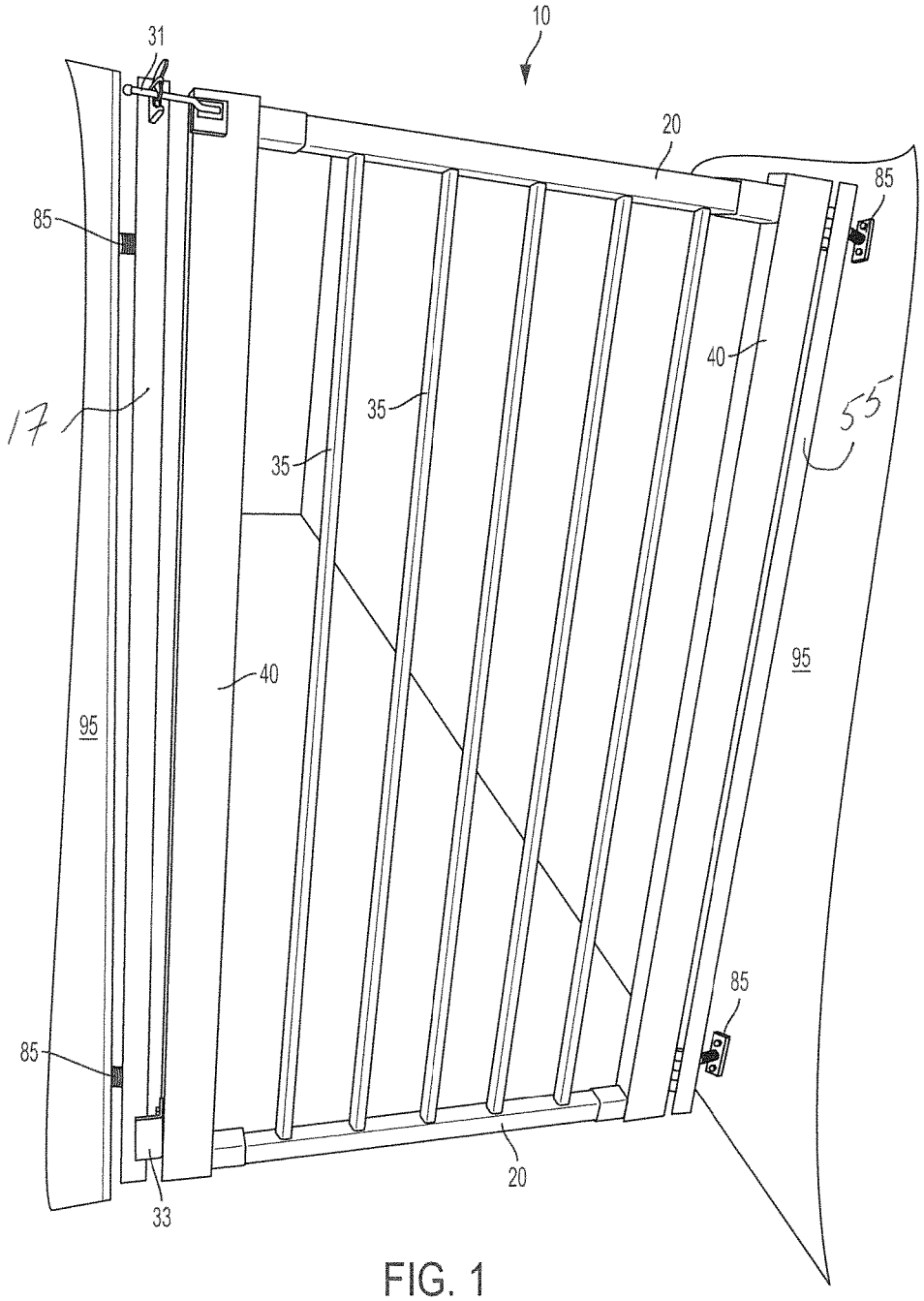
FIG. 1 is an elevation view of an adjustable gate apparatus embodying the principals of the invention.

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION OF THE PREFERRED EMBODIMENTS

In the following description, for the purposes of explanation, numerous specific details are set forth in order to provide a thorough understanding of the adjustable gate apparatus ("AGA") that embodies principals of the present invention. It will be apparent, however, to one skilled in the art that the adjustable gate apparatus may be practiced without some of these specific details. Throughout this description, the embodiments and examples shown should be considered as exemplars, rather than as limitations on the adjustable gate apparatus. That is, the following description provides examples, and the accompanying drawings show various examples for the purposes of illustration. However, these examples should not be construed in a limiting sense as they are merely intended to provide examples of the adjustable gate apparatus rather than to provide an exhaustive list of all possible implementations of the adjustable gate apparatus.

Specific embodiments of the invention will now be further described by the following, non-limiting examples which will serve to illustrate various features. The examples are intended merely to facilitate an understanding of ways in which the invention may be practiced and to further enable those of skill in the art to practice the invention. Accordingly, the examples should not be construed as limiting the scope of the invention. In addition, reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

As shown in FIGS. 1-5, and adjustable gate apparatus (AGA) 10 is illustrated. The adjustable gate apparatus includes may novel features, including a symmetrical design that allows the adjustable gate apparatus 10 to be installed any one of four (4) different ways depending on an operators' needs. The adjustable gate apparatus 10 includes a telescoping feature that makes every installation a perfect, professional fit. The adjustable gate apparatus 10 meets all state and local building codes for swimming pools and spas and self-closing code requirements. The adjustable gate apparatus 10 includes mounting tabs that address issues with un-level or out of plumb mounting surfaces allowing for a professional installation by non-skilled homeowners.

Figure 2:
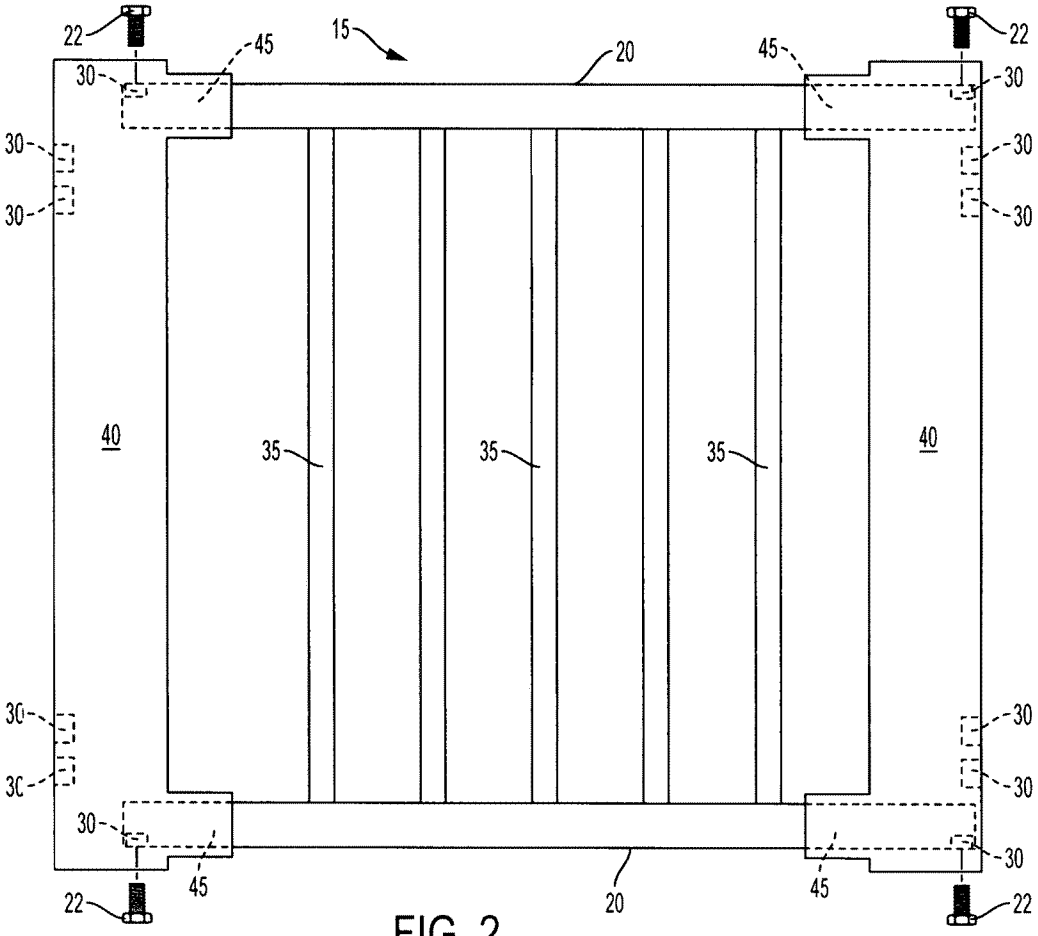
FIG. 2 is an elevation view of a gate body that is part of the adjustable gate apparatus shown in FIG. 1.

Referring to FIGS. 1-2, the adjustable gate apparatus (AGA) 10 comprises a main gate body 15 that includes two horizontal elements 20. In a preferred embodiment, the horizontal elements 20 are made from steel tubing having a square cross-section, but it will be appreciated that round, oval or other shapes may be employed. Near the end of each horizontal element 20, a threaded insert 30 is located. Threaded inserts 30 are generally barrel-shaped fasteners that are used to create threads in plastic, metal, wood, or composite materials. They provide a surface suitable for fastener mating. For example, a threaded insert comprises threads on an inner surface into which a fastener can be screwed. Generally, threaded inserts are either threaded into an aperture, or pressed into an aperture so that they are securely attached to the host material. It will be appreciated that alternatives to a threaded insert 30 may be employed. For example, the steel tubing comprising the horizontal element 20 may have threads cut directly into the steel, or the end of the horizontal element 20 could include a stamping that deforms the steel so that threads could be cut directly into the steel.

Joining the horizontal elements 20 are rods 35, but panels, boards, plates, decorative elements, and other components may be used to join the horizontal elements 20.

As shown in FIG. 2, vertical side members 40 are joined to the horizontal elements 20. The vertical side members 40 include a female collar 45 that is sized to receive the ends of the horizontal elements 20. In a preferred embodiment, the female collar 45 has a square cross-section, and is dimensioned so that the ends of the horizontal elements 20 fit closely within the collar 45, but yet allow relative movement between the female collar 45 and the ends of the horizontal elements 20.

Figure 3:
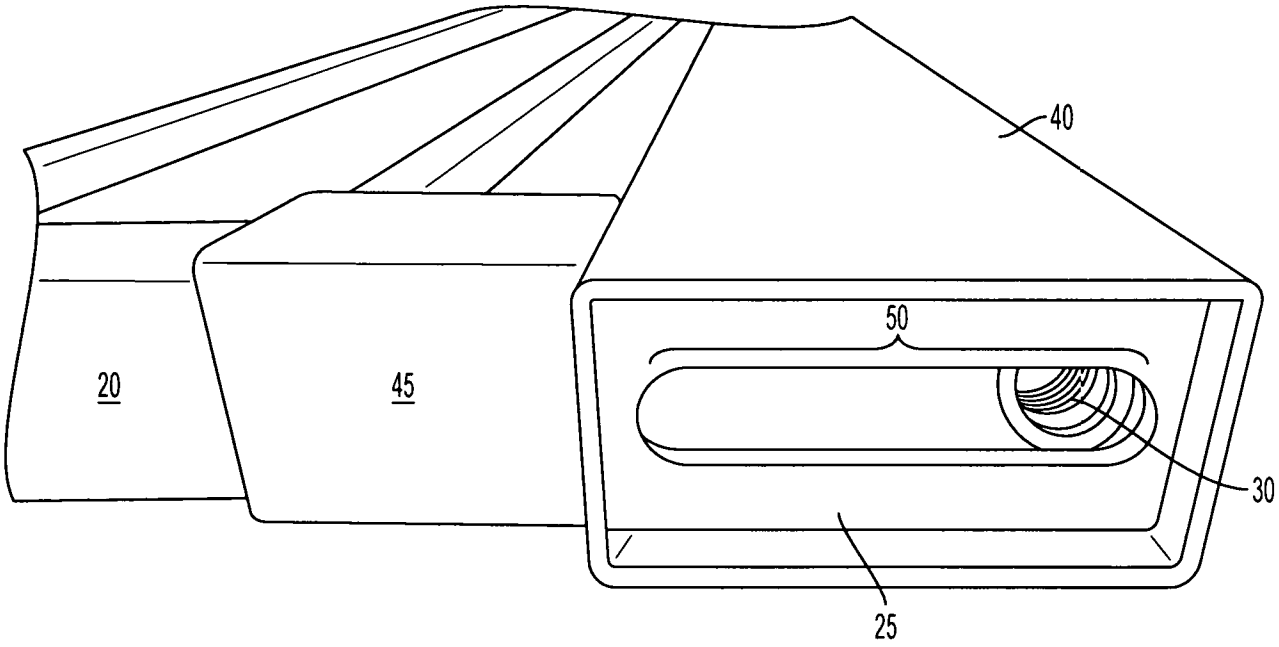
FIG. 3 is a close-up view of a corner area of the gate body shown in FIG. 2.

Referring now to FIG. 3, at the end of each of the vertical side members 40, and adjacent to the female collar 45, is a plate 25 with an elongated slot 50. The locations of the female collar 45, plate 25 and elongated slot 50 are arranged so that the threaded insert 30 can be accessed through the slot 50. This allows a fastener to be installed in the threaded insert 30, thereby fixing the position of the vertical side members 40 relative to the horizontal elements 20 (discussed in detail below).

Referring again to FIG. 2, each of the vertical side members 40 includes two sets of threaded inserts 30, with each set located near the end of each side member 40. Looking closely and FIG. 2, it becomes clear that the gate body 15 is symmetric—if you flip it over or turn it over, the shape is the same. This feature provides tremendous flexibility that permits the installation of the AGA 10 into any enclosure opening.

Figure 4:
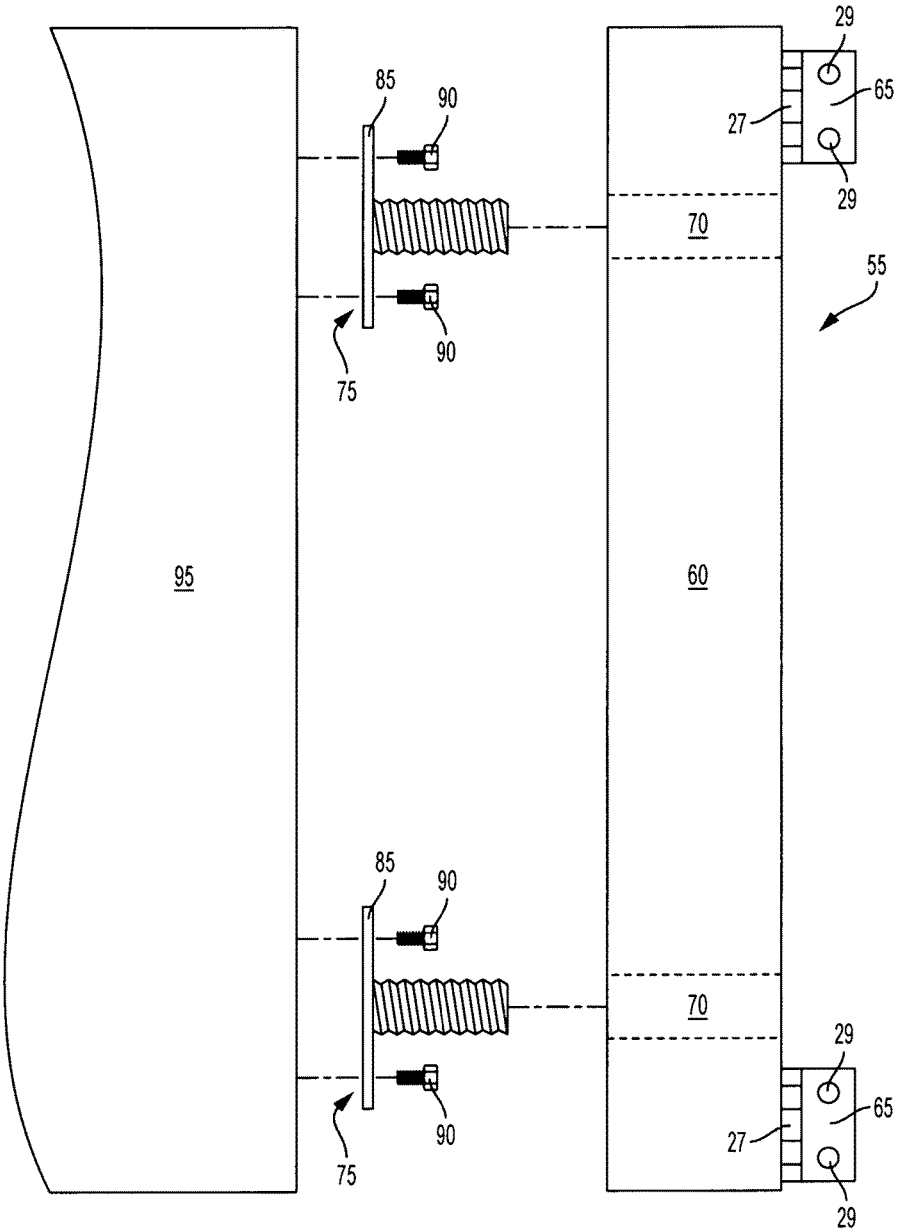
FIG. 4 is an elevation view of a hinge post that is part of the adjustable gate apparatus shown in FIG. 1.

Illustrated in FIG. 4 is a hinge post 55. The hinge post 55 includes an elongated member, or post 60 that has a hinge 65 located near each end of the post 60. The post 60 also has two threaded receivers 70. In a preferred embodiment, the threaded receivers 70 are welded into the post 60 and are similar in function to the threaded inserts 30, in that they are generally cylindrical in shape, and provide a surface suitable for fastener mating. In this case, the threaded receivers are sized to receive mounting tabs 75 that comprise a threaded rod 80 attached to a substantially rectangular mounting plate 85 that has two apertures (not shown) sized to receive mounting hardware 90. It will be appreciated that the shape of the mounting plate 85 can vary—as long as it is sized so that it can include at least one aperture through which mounting hardware 90 can be placed. Mounting hardware 90 will differ, depending upon the material of the mounting surface 95 into which it will be inserted. For example, wood fasteners, or lag screws or bolts may be used when wood is the mounting surface 95, but masonry anchors, cinder block fasteners or other types of fasteners may be used as mounting hardware 90 when the mounting surface 95 is masonry or cinder block.

Figure 5:
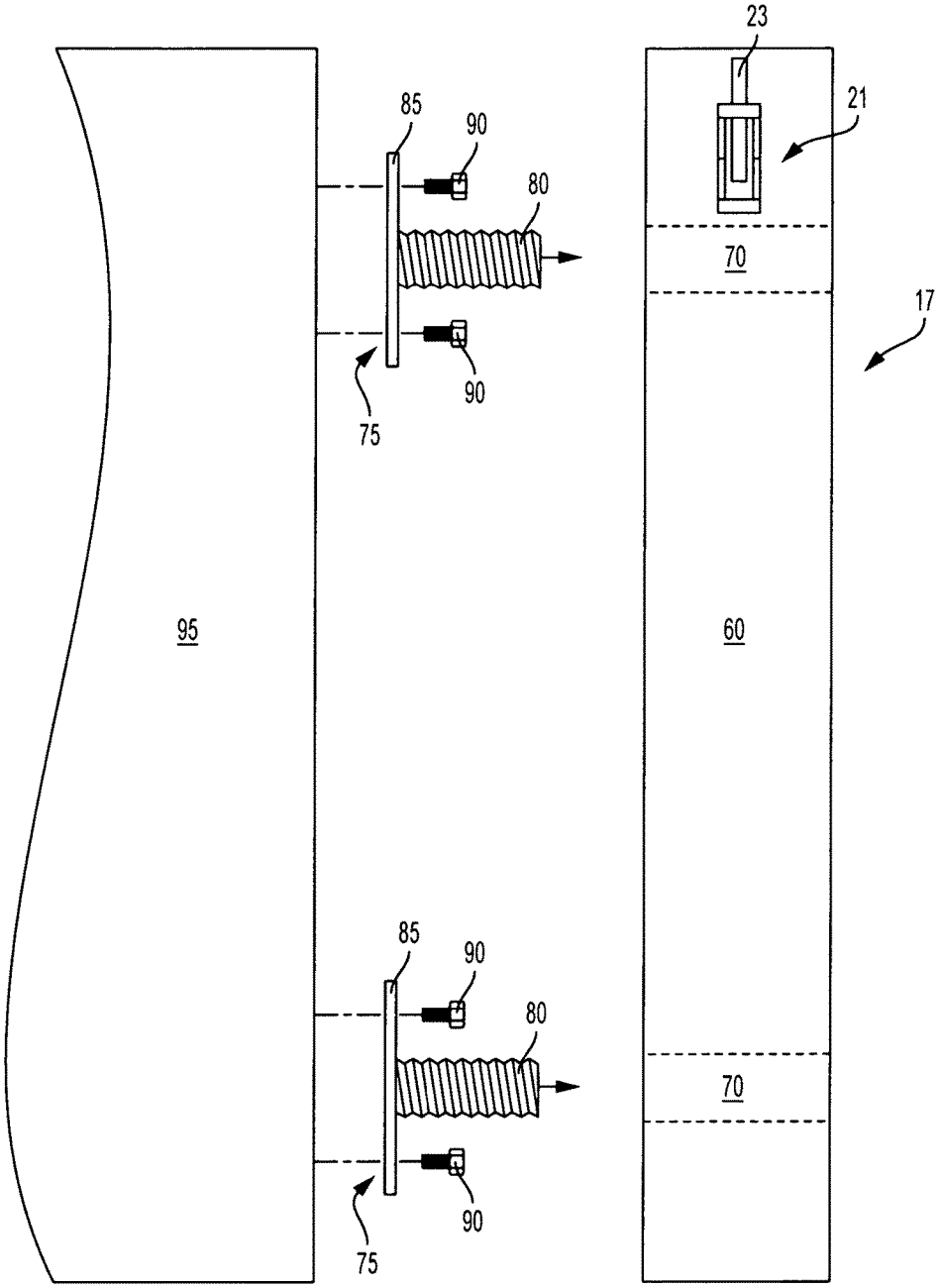
FIG. 5 is an elevation view of a latch post that is part of the adjustable gate apparatus shown in FIG. 1.

Turning now to FIG. 5, a latch post 17 is illustrated. Similar to the hinge post 55, the latch post 17 includes an elongated member, or post 60 that has a latch assembly 21 comprising a gravity catch 23 that engages a latch strike or bar 31 (shown in FIG. 1). It will be appreciated that different types of latching mechanisms may be employed by the present invention. For example, a floating gravity catch, a Suffolk latch, a twisted ring gate latch, or other latch designs may be employed.

Again referring to FIG. 5, two threaded receivers 70 are also mounted in the post 60 of the latch post 17. In a preferred embodiment, the threaded receivers 70 are welded into the post 60 and are similar in function to the threaded inserts 30, in that they are generally cylindrical in shape, and provide a surface suitable for fastener mating. In this case, the threaded receivers are sized to receive mounting tabs 75 that comprise a threaded rod 80 attached to a substantially rectangular mounting plate 85 that has two apertures (not shown) sized to receive mounting hardware 90. It will be appreciated that the shape of the mounting plate 85 can vary—as long as it is sized so that it can include at least one aperture through which mounting hardware 90 can be placed. Mounting hardware 90 will differ, depending upon the material of the mounting surface 95 into which it will be inserted. For example, wood fasteners, or lag screws or bolts may be used when wood is the mounting surface 95, but masonry anchors, cinder block fasteners or other types of fasteners may be used as mounting hardware 90 when the mounting surface 95 is masonry or cinder block.

The function of the mounting tabs 75 and the fitting and installation of the AGA 10 will now be described. As discussed above, when mounting a gate to a post, wall or other mounting surface 95, problems arise when the mounting surface 95 is not "plumb." That is, the post or wall is not exactly vertical or perpendicular to the ground. Also, in many cases, the surface across which the AGA 10 will extend is not level. For example, the AGA 10 may be located between a fence post and a wall, and the ground between the two is not exactly level, or horizontal. Installing a conventional gate in these situations is problematic at best, and more often, very difficult.

However, due to the novel features of the AGA 10, installation against mounting surfaces 95 that are not "plumb" is quick and easy. First, the desired direction for the gate body 15 to open, or swing is determined. Then, the hinge post 55 is positioned so that when the gate body 15 is coupled to the hinge post 55, the gate body 15 will open in the desired direction. For example, if it is desired for the gate body 15 to swing toward the operator, with the hinges 65 on the right side of the gate body 15 (as shown in FIG. 1) the hinge post 55 is placed on the right side of the gate body 15 with the hinge barrels 27 facing up, toward the operator. Then each hinge 65 is coupled, or bolted to the vertical side member 40 by inserting fasteners through the hinge apertures 29 and into the threaded inserts 30 located in the side of the vertical side member 40.

Next, a width of the gate body 15 is adjusted. First, the location where the gate will be installed is measured and the width of the gate body 15 is adjusted by sliding the horizontal elements 20 relative to the vertical side members 40 until a desired gate body 15 width is achieved. Then, a fastener 22 is inserted into the slot 50 and into threaded insert 30 located near the end of each horizontal element 20 (shown in FIGS. 2 and 3). This locates, or secures the position of the horizontal elements 20 relative to the vertical side members 40. In this way the AGA 10 can be installed into different width openings quickly and easily.

Then, the gate body 15 and hinge post 55 are positioned next to the mounting surface 95 so that the mounting plates 85 are resting against the mounting surface 95. The mounting surface 95 may be a wall, fence post, or other surface. The gate body 15 and hinge post 55 are elevated slightly, for example, by placing a wood block under them, so that when installed, the gate body 15 will swing freely. A level or other device is placed on top of the gate body 15 (on the horizontal element 20), and the mounting tabs 75 are rotated clockwise or counterclockwise, thereby increasing or decreasing their distance from the post 60. Specifically, by rotating the mounting tabs 75, the threaded rod 80 is either threaded further into the post 60, or unscrewed away from the post 60. In so doing, the gate body 15 can be adjusted so that it is level, even if the mounting surface 95 is not exactly vertical. One feature of the AGA 10 is that the mounting tabs 75 can be adjusted to compensate for non-vertical mounting surfaces 95. That is, the adjustable mounting tabs 75 allow the post 60 to be positioned vertically, even when the mounting surface 95 is not exactly vertical. Once the gate body 15 is level, fasteners 90 are inserted though the apertures in the mounting plate 85 and into the mounting surface 95, attaching the hinge post 55 to the mounting surface 95.

Referring now to FIG. 1, the latch strike 31 and the stop tab 33 are now coupled to the vertical side member 40 by threading fasteners through apertures in the latch strike 31 and the stop tab 33 and into threaded inserts 30. One feature of the AGA 10 is that the latch strike 31 and the stop tab 33 can be installed on any corner of the gate body 15. This feature, along with the hinge post 55, which can be rotated, allows the AGA 10 to be installed in any orientation. For example, the gate body 15 can swing toward the operator, or away from the operator, and the hinge post 55 can be to the left or right of the operator. This flexibility allows the AGA 10 to be installed in any location.

Referring now to FIGS. 1 and 5, the latch post 17 is positioned against the other mounting surface 95. Similar to the procedure discussed above in connection with mounting the hinge post 55, the mounting plates 85 are positioned against the mounting surface 95. The mounting surface 95 may be a wall, fence post, or other surface. The mounting tabs 75 are rotated clockwise or counterclockwise, thereby increasing or decreasing their distance from the post 60. Specifically, by rotating the mounting tabs 75, the threaded rod 80 is either threaded further into the post 60, or unscrewed away from the post 60. As discussed above, the adjustable mounting tabs 75 allow the post 60 to be positioned vertically, even when the mounting surface 95 is not exactly vertical. Once the latch post 17 is vertical, fasteners 90 are inserted though the apertures in the mounting plate 85 and into the mounting surface 95, attaching the latch post 17 to the mounting surface 95.

It is to be noted that the term "comprising", used in the claims, should not be interpreted as being limitative to the elements listed thereafter. Thus, the scope of the expression "an apparatus comprising A and B" should not be limited to devices consisting only of components A and B. It means that with respect to the present invention, the only relevant components of the apparatus are A and B.

Similarly, it is to be noted that the term "coupled", also used in the claims, should not be interpreted as being limitative to a fixed or direct connection only. Thus, the scope of the expression "A element coupled to B element" should not be limited to arrangements where A is unmovably fixed to B, or that A is directly in contact with B. It means that A may move relative to B or that other elements may be positioned between A and B.

The terms "an embodiment", "embodiment", and "a preferred embodiment", mean "one or more (but not all) embodiments of the present invention(s)" unless expressly specified otherwise. The terms "including", "comprising" and variations thereof mean "including but not limited to", unless expressly specified otherwise. The terms "a", "an" and "the" mean "one or more", unless expressly specified otherwise.

Thus, it is seen that an adjustable gate apparatus is provided. One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that many alternatives, modifications, permutations and variations will become apparent to those of ordinary skill in the art in light of the foregoing description. Accordingly, it is intended that the present invention embrace all such alternatives, modifications and variations as fall within the scope of the appended claims. The fact that a product, process or method exhibits differences from one or more of the above-described exemplary embodiments does not mean that the product or process is outside the scope (literal scope and/or other legally-recognized scope) of the following claims.

What is claimed is:

1. An adjustable gate apparatus, comprising:

a body comprising:

two horizontal elements, each having two respective distal ends, with a respective threaded member located at each one of the distal ends;

two vertical side members, with the horizontal elements moveably coupled to the two vertical side members, each of the two vertical side members having two respective distal ends, with a respective elongated slot extending through each of the two vertical side members and located at each one of the distal ends, where a respective one of the threaded members is accessible through a respective one of the elongated slots;

a hinge post comprising a first elongated member having a hinge and an adjustable hinge post mounting tab coupled to the first elongated member; and a latch post comprising a second elongated member having a latch apparatus and an adjustable latch post mounting tab coupled to the second elongated member;

where the adjustable hinge post mounting tabs and adjustable latch post mounting tabs are structured to couple to a respective mounting surface and the hinge is structured to couple to one of the two vertical side members and the latch apparatus is structured to removeably couple to the other of the two vertical side members;

where each of the vertical side members further comprise:

an upper and a lower distal portion, with at least two threaded apertures located at each of the upper and the lower distal portion, the threaded apertures each capable of mounting the hinge so that the body is positionable in a plurality of different orientations, the different orientations consisting of:

the body rotatably mounted to the hinge post on a first side of the body;

the body rotatably mounted to the hinge post on a second side of the body; and where the body is moveable in a first and a second direction.

2. The adjustable gate apparatus of claim 1, further comprising:

a respective female collar located at each respective one of the distal ends of each of the two vertical side members, with each collar including an elongated slot.

3. The adjustable gate apparatus of claim 2, where each of the horizontal elements further comprise:

a respective end section at each one of the distal ends sized to slideably fit within a respective one of the female collars.

4. The adjustable gate apparatus of claim 1, where each of the vertical side members further comprise:

an upper and a lower distal portion, with at least two threaded apertures located respectively at each of the upper and the lower distal portion, the two threaded apertures capable of interchangeably mounting the hinge, a stop plate, or a latch strike element to each of the vertical side members.

5. An adjustable gate, comprising:

a body comprising:

two horizontal elements, each having two respective distal ends, with a respective threaded member located at each one of the distal ends;

two vertical side members, each having two respective distal ends, with a respective elongated slot extending through each of the two vertical side members and located at each one of the distal ends, where a respective one of the threaded members is accessible through a respective one of the elongated slots;

two threaded apertures located at each of an upper and a lower distal portion of each of the vertical side members, the threaded apertures each capable of interchangeably mounting a hinge, a stop plate, or a latch strike element;

a hinge post comprising a first elongated member having the hinge and an adjustable hinge post mounting tab coupled to the hinge post, the hinge post positionable relative to the body so that the hinge is positioned in a desired orientation; and a latch post comprising a second elongated member having a latch apparatus and an adjustable latch post mounting tab coupled to the latch post;

where the adjustable hinge post and latch post mounting tabs are structured to couple to a mounting surface;

where each of the vertical side members further comprise:

an upper and a lower distal portion, with two threaded apertures located at each of the upper and the lower distal portion, the threaded apertures each capable of mounting the hinge so that the body is positionable in a plurality of different orientations, the different orientations consisting of:

the body rotatably mounted to the hinge post on a first side;

the body rotatably mounted to the hinge post on a second side; and where the body is moveable in a first and a second direction.

6. The adjustable gate of claim 5, where the hinge is structured to couple to either of the vertical side members and the latch strike element is structured to removeably couple to either of the vertical side members.

7. The adjustable gate of claim 5, further comprising:

a respective female collar located at each respective one of the distal ends of each of the two vertical side members, with each collar including an elongated slot.

8. The adjustable gate of claim 7, where each of the horizontal elements further comprise:

a respective end section at each one of the distal ends sized to slideably fit within a respective one of the female collars.

* * * * *